US007237970B2

(12) United States Patent
Bolton

(10) Patent No.: US 7,237,970 B2
(45) Date of Patent: Jul. 3, 2007

(54) MARKER PENS

(75) Inventor: Terence W. Bolton, Turners Hill (GB)

(73) Assignee: Terrence W. Bolton (GB)

( * ) Notice: Subject to any disclaimer, the term of this patent is extended or adjusted under 35 U.S.C. 154(b) by 333 days.

(21) Appl. No.: 10/467,416

(22) PCT Filed: Feb. 6, 2002

(86) PCT No.: PCT/GB02/00486

§ 371 (c)(1),
(2), (4) Date: Feb. 13, 2004

(87) PCT Pub. No.: WO02/064379

PCT Pub. Date: Aug. 22, 2002

(65) Prior Publication Data

US 2004/0161282 A1 Aug. 19, 2004

(30) Foreign Application Priority Data

Feb. 9, 2001 (GB) ..... 0103238.2

(51) Int. Cl.
*B43K 27/04* (2006.01)
*B43K 5/00* (2006.01)

(52) U.S. Cl. ..... 401/35; 401/34; 401/198

(58) Field of Classification Search ..... 401/196, 401/198, 199, 34, 35
See application file for complete search history.

(56) References Cited

U.S. PATENT DOCUMENTS

| | | | | |
|---|---|---|---|---|
| 3,887,287 | A | 6/1975 | Rosh, Jr. | 401/35 |
| 5,026,189 | A * | 6/1991 | Keil | 401/29 |
| 5,306,092 | A * | 4/1994 | Jenq | 401/47 |
| 5,388,924 | A * | 2/1995 | Chao | 401/35 |
| 5,412,021 | A | 5/1995 | Nakanishi | 524/523 |
| 6,554,517 | B2 * | 4/2003 | Ahmed | 401/35 |
| 6,766,817 | B2 | 7/2004 | Da Silva | |

FOREIGN PATENT DOCUMENTS

| | | |
|---|---|---|
| WO | WO 91/00810 | 1/1991 |
| WO | WO 94/09997 | 5/1994 |

* cited by examiner

*Primary Examiner*—David J. Walczak
(74) *Attorney, Agent, or Firm*—Blank Rome LLP

(57) ABSTRACT

A marker pen comprises a tubular housing from one end of which protrudes a first fluid retaining nib replenished by fluid such as an indicator ink present in a first chamber positioned within the housing, and a second fluid retaining nib which also protrudes from the aforesaid end of the housing and is replenished by fluid such as an eradicator fluid present in a second chamber positioned within the housing. The protruding nibs are spaced one from the other.

28 Claims, 7 Drawing Sheets

MARKER PENS

This invention relates to marker paens.

Typically marker pens comprise a tubular housing having a fibrous felt-like nib connected via a liquid absorbent wick to an internal reservoir containing an indicator such as a water-based ink which contains a coloured dye. As the marker pen is used the fibrous nib is replenished with ink which travels from the reservoir by capillary action to the nib via the wick. Such pens are well known and are used inter alia to mark text and produce coloured effects on paper or similar materials. Known marker pens are used to produce a line of a single colour. To produce adjoining lines of different colour two or more pens are required.

Fluids which produce a colour change when applied to a water-based ink containing a dye on a surface, or which eradicate the colour of the dye present in the water-based ink, are also well known.

By definition dyes are aromatic organic compounds having delocalised electron systems, which absorb electromagnetic radiation of various wavelengths. Dye colours are produced by the presence in the respective dye of a chromophore. A chromophore is an atomic configuration that alters the energy in a delocalised electron cloud of a dye, resulting in the compound absorbing radiation from the visible range of the spectrum and thus producing colour.

Acid-base indicators are dyes which are themselves weak acids and bases, the conjugate acid and base forms having different colours. Conversion between acid and base forms is obtained by changing the pH of the indicator.

When an acid-base indicator is applied as a dye on, for example, a sheet of paper and an acidic or basic chemical is subsequently applied to alter the pH of the dye, a transition between the acidic and basic forms of the dye results in a change or disruption of the respective chromophore. This disruption causes the wavelength of radiation/light which the dye originally absorbed to change, to a value which is either outside the visible range (colour eradication) or at a value within the visible range of another colour (colour change).

An applicator for eradicating or removing transparent or translucent emphasizing inks is disclosed in U.S. Pat. No. 5,427,278. This applicator comprises a container, a liquid bleaching or oxidising agent in the container for the emphasizing ink and means on one end of the container, such as a felt tip, roller, pressurised spray nozzle or hand pump, to apply a thin film of the ink removing agent to the emphasizing ink and to effect the eradication or removal thereof without substantially affecting the underlying ink or printed material which has been emphasized. Such an applicator is used to eradicate ink or dye laid down by a separate marker pen.

An applicator formed at one end with a writing nib connected to an ink reservoir through a wick, and at its other end with an eradicator in the form of a felt, fibrous or porous member connected to a tip is disclosed in U.S. Pat. No. 4,557,618. The alignment of the applicator as disclosed in this document is reversed from its normal writing function when eradication is required.

U.S. Pat. No. 4,227,930 discloses a ball point ink pen including an eradicator. The eradicator is located on one end of the pen and the ball point on the other end of the pen. If an error is made, the pen is reversed and the eradicator used to neutralise the ink.

Felt-tipped marker pens are known which have two or more marker nibs protruding from the same end of the marker housing.

One object of the present invention is to provide a marker pen capable of producing in one stroke a stripe of one colour with a line or lines of another colour or colours between the boundaries of the stripe, the line or lines being produced by a colour change or blending technique. Another object is to provide a marker pen capable of producing in one stroke a coloured stripe with a clear line or lines between the boundaries of the stripe. Because the stripe and line(s) are produced in one stroke, blending at the edges of the stripe and line(s) occurs because both the stripe and the line(s) are wet when applied to the writing surface.

A further object is to provide in one stroke a marker pen capable of producing a coloured stripe with a line of another colour or no colour between the boundaries of the stripe regardless of the direction of movement of the marker pen over a writing surface. This objective is achieved because one nib is positioned generally centrally with respect to the other nib.

In one aspect, the invention provides a marker pen which comprises a tubular housing, a first fluid retaining nib protruding from one end of the housing, and a second fluid retaining nib protruding from the same end of the housing and means for separating the nib surfaces one from the other, the first nib being positioned and dimensioned to produce a stripe and the other nib being positioned and dimensioned to produce a line or lines between the boundaries of the stripe.

According to the present invention in another aspect, there is provided a marker pen which comprises a tubular housing from one end of which protrudes a first fluid retaining nib replenished by fluid present in a first chamber positioned within the housing, and a second fluid retaining nib which also protrudes from the aforesaid end of the housing and is replenished by fluid present in a second chamber positioned within the housing, the protruding nibs being spaced one from the other.

The first nib is preferably produced from a porous material. The second nib may also be produced from a porous material. Alternatively the second nib may comprise a thin tube of an impermeable material formed with a capillary passageway or housing a porous fluid retaining material. The fluid retaining material may comprise a mass of fibrous material, a sponge, or a relatively solid porous material.

The first nib may be formed with an opening through which the second nib at least partially protrudes. In this arrangement the first nib may be annular or ring-shaped in a plane normal to the longitudinal axis of the nib. The sides of the first nib may lie generally parallel to its longitudinal axis; alternatively the diameter of the nib at its distal end may be less than that at its housing encompassed end. Thus the first nib may be generally frustoconical with a central bore passing from one end to the other. The distal end of the first nib may be generally flat, i.e. not pointed. Other shapes of nib may, however, be employed. Thus in cross-section the outer contour of the first nib may be oval, square, rectangular or indeed any other suitable shape.

The first nib may comprise a generally annular array of a plurality of separate pieces of absorbent material, the second nib at least partially protruding through the bore defined by the annular array. In this arrangement, the individual pieces of the first nib may be connected to receive fluid from the first chamber of the housing.

The outer surface of the distal end of the first nib is preferably relatively inflexible and may comprise the material POREX. This is a porous fluid retaining substance which holds its shape when applied to a surface in the manner of a marker to paper, card or like material. Alternatively the distal end of the first nib may be produced from a felt or an expanded foam material, for example an expanded polystyrene.

The first nib may be connected to receive fluid from the first chamber through a wick. The first chamber typically comprises a transorb. A transorb essentially comprises a quantity of fluid retaining fibrous material positioned within an impermeable sheath. The fluid retaining material may be a fibrous material. The sheath is typically open at both ends one of which receives a wick by which fluid present in the transorb is passed by capillary action to a nib of a marker pen.

The first chamber may be tubular in cross-section with its outer wall lying adjacent or in contact with the inner wall of the housing.

The fluid present in the first chamber may comprise an indicator such as a water-based ink containing a coloured dye, dispersed pigment or other colouring medium. Other fluids, for example water, may alternatively be present in the first chamber.

The distal end of the second nib may be generally pointed and the nib in cross-section may be circular. Other cross-sections can, however, be employed, these including oval, square and rectangular.

The second nib may be connected to receive fluid from the second chamber through a wick. The second chamber may also comprise a transorb and may contain a quantity of fibrous or other absorbent material soaked with a fluid. The second chamber may be tubular in cross-section with its outer wall lying adjacent or in contact with the internal periphery of the annular first chamber. Alternatively, the second chamber may be positioned within the housing alongside the first chamber.

The fluid present in the second chamber may comprise an indicator such as a water-based ink containing a coloured dye, dispersed pigment or other colouring medium, a solution of an eradicating material which, in use, reacts chemically with a coloured dye or dispersed pigment in an ink or other colouring medium either to eradicate or cause a colour change in the colouring medium dispensed by the first nib.

The invention will now be described, by way of example only, with reference to the accompanying diagrammatic drawings in which.

In each of the embodiments, the same reference numerals have been used for the same or similar integers.

Figure 1:
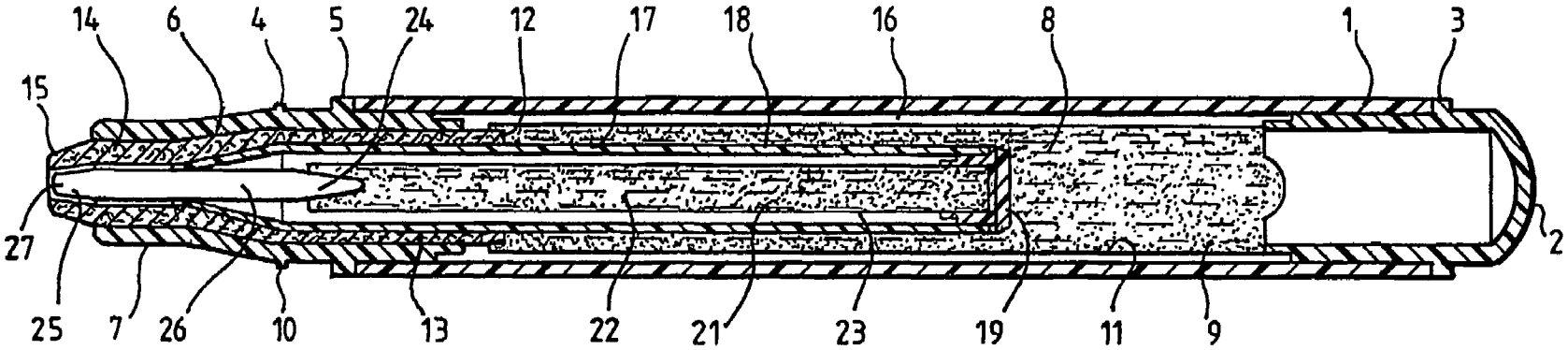
FIG. 1 is a section taken along the length of a marker in accordance with the invention.

The marker pen illustrated in FIG. 1 comprises an elongate hollow generally tubular outer casing 1 typically produced from a plastics material. Other materials can however be employed. One end of the casing 1 is closed by a bung 2 dimensioned to define a tight fit within one open end of the casing. The bung 2 is typically produced from a plastics material and is formed with an annular shoulder 3 which abuts against the adjacent rim of the casing. Positioned partially within the casing and remote from the bung 2 is a tubular ferrule 4. The ferrule is a friction fit with the open end of the casing 1 and is formed with an upstanding annular shoulder 5 which abuts against an adjoining rim of the casing. The part of the ferrule 4 remote from the casing 1 has a generally fristoconical length 6 and an end portion 7 which is of generally uniform cross-section. The ferrule may also be produced from a plastics material.

The external surface of the ferrule 4 is formed with an upstanding ring 10 over which the mouth of an aerated cap can locate.

Positioned within the casing is a transorb 8 comprising a mass of fluid retaining fibrous material 9 encased within an impermeable plastics sheath 11. The sheath material may comprise an acetate coating. The sheath 11 is closed at its end which adjoins the bung 2. An end portion 12 and wick portion 13 of an annular nib 14 protrudes through openings formed in the end of the sheath remote from the bung 2 and is immersed in the fluid containing fibrous material 9 of the transorb 8. The nib 14 and its wick portion 13 fit snugly within the interior of the ferrule 4. Longitudinal movement of the nib relative to the ferrule is achieved by applying pressure to the tip of the nib 14.

The nib 14 is produced from a porous material such as felt, an expanded foam, a material such as that marketed under the trade name POREX or indeed any material which enables fluid from the transorb 8 to flow by capillary action through the nib 14 to its tip 15. POREX is a mouldable porous material produced by or on behalf of Porex Technologies Corporation. Essentially it comprises a sintered mass of thermoplastic polymer pellets, especially micropellets made by rapid water quenched pelletizing of the polymers. The pellets are generally of a uniform size and shape, each having approximately equal dimensions along three mutually perpendicular axes, have smooth surfaces, narrow pore size distributions, greater strength and other improved characteristics.

The sheath 11 of the transorb 8 is spaced from the inner wall of the casing to define an airway 16 which ensures that the air pressure within the marker pen is atmospheric. Thus, this passageway communicates with the atmosphere for pressure equalisation purposes. Any other method or means for pressure equalisation may be employed.

The transorb 8 is formed with an annular section 17 at its end remote from the bung 2 within which is positioned a hollow tubular housing 18 typically produced from a plastics material. The housing is closed at one end by a cap 19. The internal walls of the annular transorb section 17 are lined with an impermeable plastics material and the walls of the housing 18 lie in contact with this impermeable lining.

Positioned within the housing 18 is a second transorb 21 comprising a mass of fluid retaining fibrous material 22 encased within an impermeable plastics sheath 23. An end section 24 of an inner nib 25 protrudes through openings formed in the end of the sheath 23 remote from the end cap 19 and is immersed in the fibrous material 22 of the transorb 21. The second nib 25 including its wick section 26 extends through the central passageway of the annular nib 14.

The nib 25 is formed with a lengthwise extending narrow passageway through which fluid from the transorb 21 passes by capillary action to the tip 27 of the nib 25. An orifice is formed in the tip 27 to enable fluid to pass from the nib to, for example, a sheet of paper. In one arrangement, the nib 25 is produced as a hollow plastics, metallic or ceramic tube formed with an internal capillary passageway or filled with a porous material such as a mass of fibrous material. Alternatively, the nib 25 may be produced from a porous material such as POREX, felt or the like.

As will be seen from FIG. 1, the outer walls of the transorb 21 are spaced from the inner walls of the housing 18 to ensure that the marker interior is at atmospheric pressure.

Figure 2:
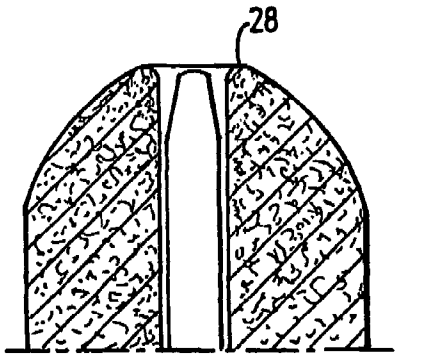
FIGS. 2 and 3 show to enlarged scales features of nibs of the marker illustrated in FIG. 1.
Figure 3:
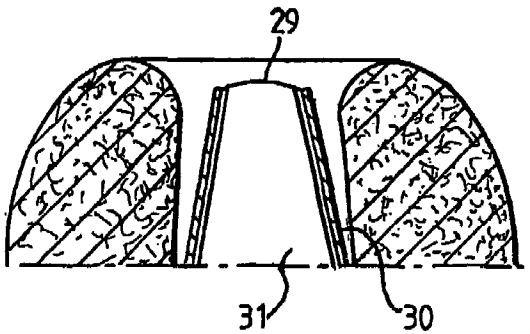

It will also be seen from FIG. 1 that the opposed peripheries of the nibs 14, 25 and their wick sections are separated one from the other. This feature is better illustrated in FIGS. 2 and 3. As will be seen, at no point is there contact between the nibs 14, 25 thereby avoiding any contamination between the liquids of the respective nibs. As shown in FIGS. 2 and 3, the tip of the nib 25 tapers inwardly over its end portion to increase the spacing between the nibs at their tips. Also, the edges 28 of the annular nib 14 are rounded also with the intention of preventing any cross contamination of the fluids dispensed from the nibs in use. Typically, the tip diameter of nib 25 approximates to 1 mm and the diameter of the internal passageway of the annular nib 14 is 2 mm. FIG. 3 shows the orifice 29 formed in the tip of nib 25, the hollow tube 30 and the wick 31 present within the tube.

As shown in FIG. 3, when not in use the tip of the annular nib 14 protrudes beyond the tip of the inner nib 25. This enables a user to dispense fluid only from the annular nib 14 using relatively light pressure, and to dispense fluid simultaneously from both nibs 14, 25 with slightly increased pressure. Relative movement between the nib 14 and the casing 1 (and therefore between the nibs 14 and 25) is discussed above.

Figure 4:
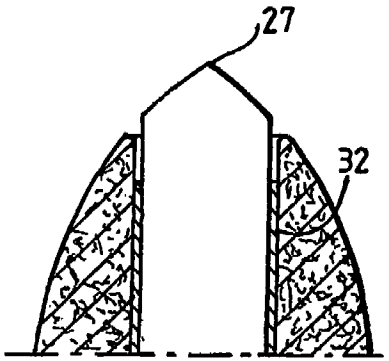
FIG. 4 is a sectional view of an alternative marker nib in accordance with the invention.

FIG. 4 shows an alternative embodiment in which the tip of the inner nib 25 protrudes beyond the tip of the annular nib 14. In this embodiment, therefore, a user can elect to write only with the inner nib or with both the inner and annular nibs by applying a slightly increased pressure. In FIG. 4, the spacing between the nibs 14, 25 is essentially provided by an impermeable sheath 32.

Figure 5:
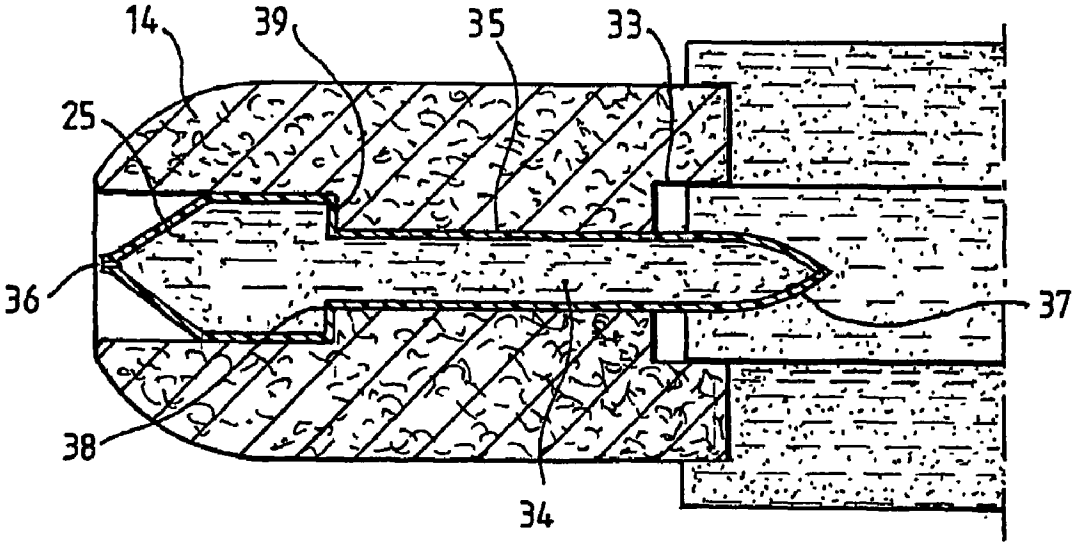
FIG. 5 shows in section a part of an alternative marker in accordance with the invention.

The annular nib 14 of the marker pen illustrated in FIG. 5 has formed in its end remote from its tip a recess 33. The adjoining end of the inner transorb protrudes into this recess whereby the extent of movement of the annular nib 14 can be limited. In this embodiment, the inner nib 25 comprises a mass of fluid retaining fibrous material 34 contained within a relatively hard plastics sheath 35. The tip of the nib 25 is formed with an opening 36 through which, in use, fluid can pass from the nib to, for example, a sheet of paper. The end of the plastics sheath 34 remote from the nib tip is formed with one or more openings 37 to enable fluid to pass from the inner transorb and through the fibrous mass 34 by capillary action to the tip of the nib.

The tip-end of the nib 14 is formed with an annular step 38 which seats against a ledge 39 provided within the interior of the nib 14. Cooperation between the step 38 and ledge 39 limits the extent of movement of the inner nib 25 within the annular nib 14.

Figure 6:
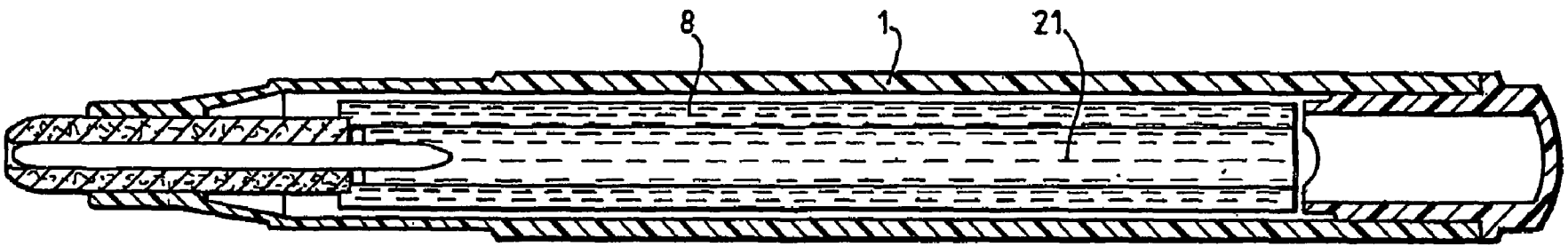
FIG. 6 is a section taken along the length of a further marker in accordance with the invention.

The marker pen illustrated in FIG. 6 is similar to that shown in FIG. 1. In this embodiment, however, the casing 1 is formed integrally with the ferrule and the transorbs 8, 21 are generally coextensive with transorb 21 located generally coaxially within the central passageway of the annular transorb 8. In this embodiment the transorbs are separated simply by their impermeable plastics sheaths. The transorbs may be vacuum formed. Also, the annular nib 14 is generally linear.

As shown in FIG. 6, the end of the nib 14 remote from its tip protrudes into an opening formed in one end of the transorb 8. In an alternative arrangement, the nib end may include an annular extension or a series of projecting fingers which protrude to a greater or lesser extent into the fibrous mass of the transorb 8.

Figure 7:
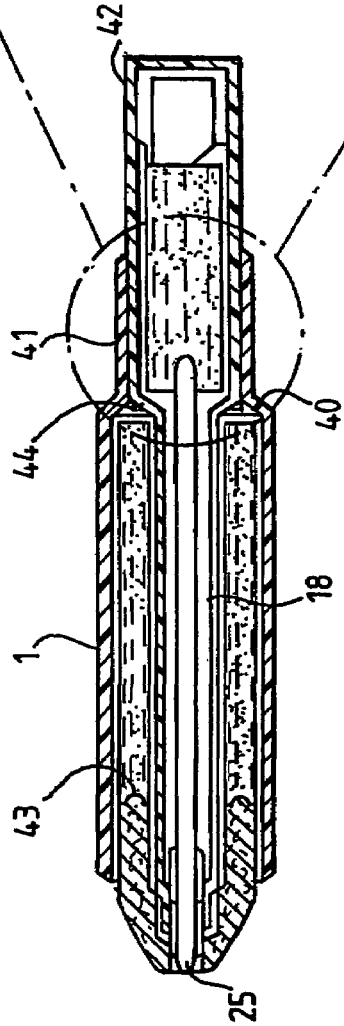
FIG. 7 is a section taken through a yet further marker in accordance with the invention.

Turning now to FIG. 7, in this embodiment the diameter of the outer casing 1 is reduced at one end to define a socket 41 into which is received and retained a complementary socket 42 formed at one end of the housing 18. The annular shoulder 40 produced by the change in casing diameter defines an end stop for the transorb 8. In this embodiment, therefore, the transorb 21 is displaced axially from the transorb 8 of the annular nib 14. The wick end of the annular nib 14 is formed with rearwardly extending nipples 43 to assist the flow of liquid from the transorb 8 to the tip of the nib 14. The nibbed end of the marker pen may be releasably covered by an aerated cap.

Figure 9:
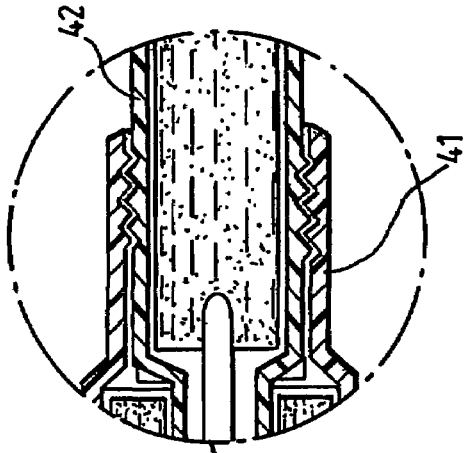
FIGS. 8 and 9 are sectional views to enlarged scales of features of the marker illustrated in FIG. 7.
Figure 8:
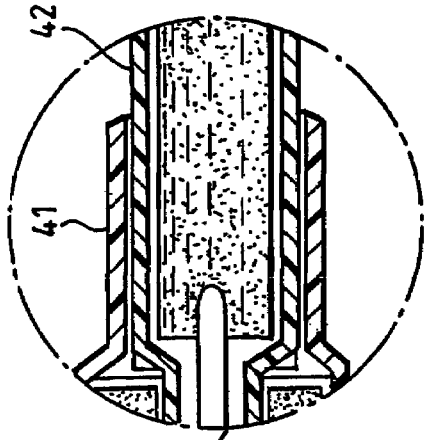

The housing 18 has a tapered neck 44 to enable the housing end remote from the socket 42 to pass through the internal passageway of the annular transorb 8. The socket 42 may be dimensioned to define a friction fit within the socket 41 as shown in FIG. 8, or may be connected to the socket 41 through cooperating screw-threads as shown in FIG. 9. Alternatively, the sockets 41, 42 may connect through a snap action. In both cases, relative movement between the outer casing 1 and the housing 18 in a longitudinal sense is possible. Thus, the position of the tip of the nib 25 can be changed simply by moving the socket 42 relative to the socket 41.

As will be seen from FIG. 7, the inner nib 25 is spaced from the inner wall of the housing 18 at a position close to the nib tip by a centralising ferrule. This ferrule has openings or fins for the flow of air for pressure equalisation purposes.

Figure 10:
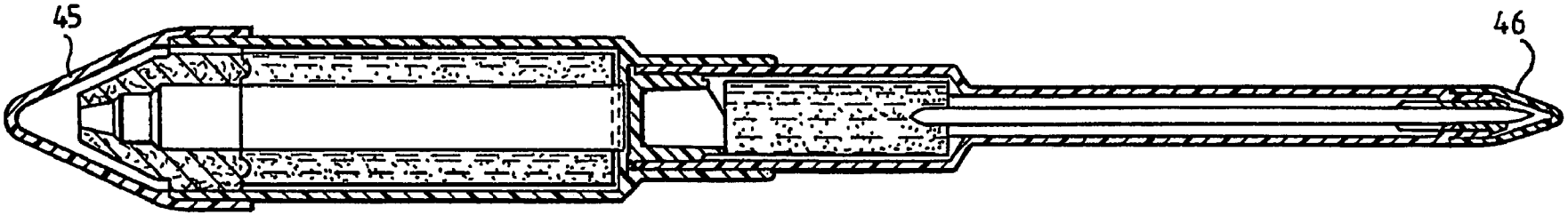
FIGS. 10 and 11 are sectional and perspective views respectively of the marker shown in FIG. 7 in a different mode.
Figure 11:
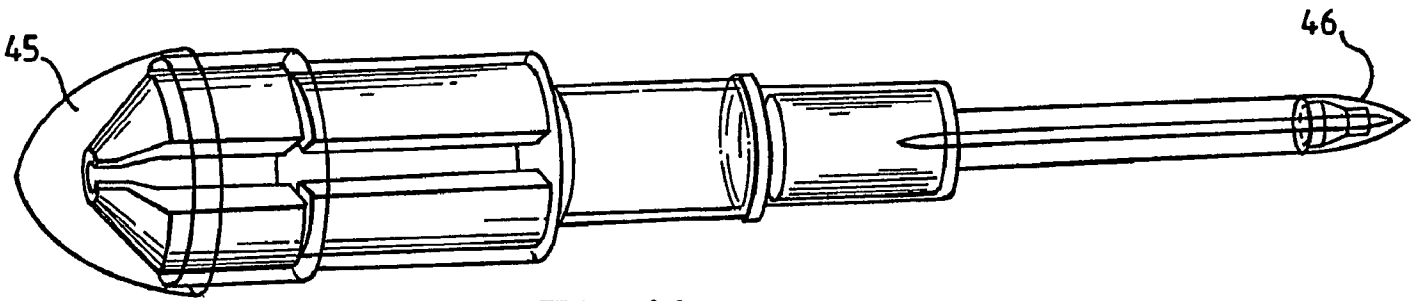

One advantage of the embodiment illustrated in FIGS. 7 to 9 is that the housing 18 including the inner nib 25 can readily be withdrawn from the casing 1, reversed and reinserted into the socket 41 of the casing 1. This reversed position is shown in FIGS. 10 and 11. In this way, the nibs can be used either separately or together. As will be seen from FIGS. 10 and 11, end caps 45, 46 are provided to seal the nib tips when not in use. An additional advantage is that a variety of housings and transorbs can be employed in combination with the casing 1 and its transorb.

Figure 12:
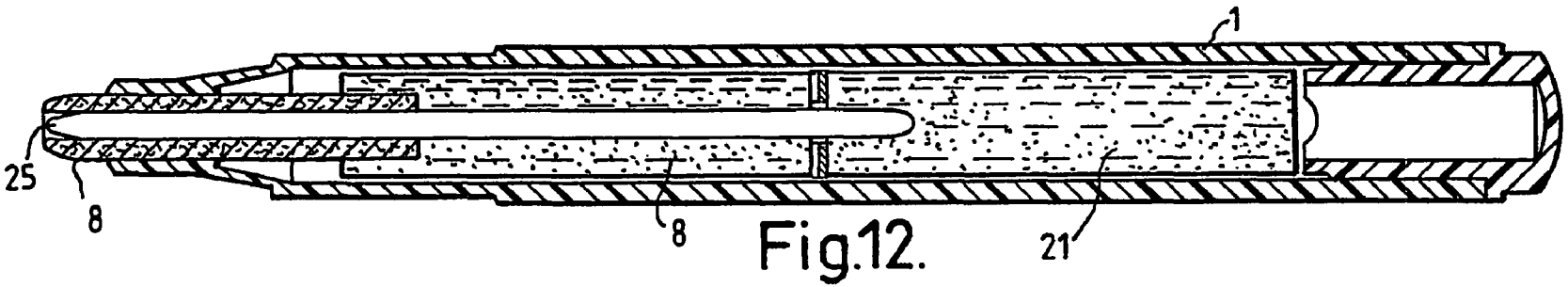
FIGS. 12 and 13 are sections taken along the length of further markers in accordance with the invention.

In the embodiment illustrated in FIG. 12, the casing 1 is similar to that shown in FIG. 6. In this embodiment, however, the transorbs 8, 21 are positioned in line rather than coaxially. As will be seen from FIG. 12, the wick section of the nib 25 extends lengthwise through the central passageway of the annular transorb 8 and protrudes into the fibrous mass present in the transorb 21. The wick section of the nib 8 is protected from the fluid retaining fibrous mass of the transorb 8 by the internal plastics sheath of the transorb. An 'O' shaped plastics collar is positioned between the opposed ends of the transorbs with a space defined between one collar surface and the opposed end of the transorb 8 or 21 for pressure equalisation purposes.

Figure 13:
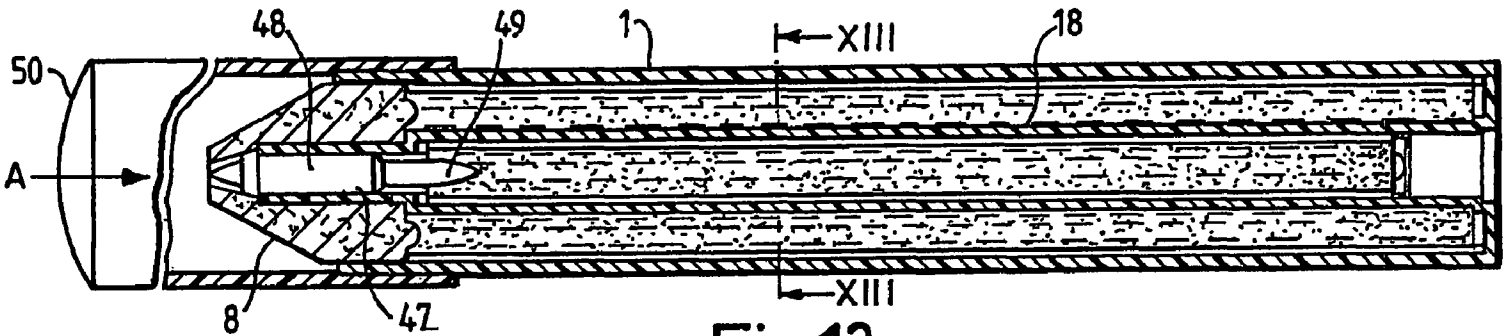
Figure 13B:
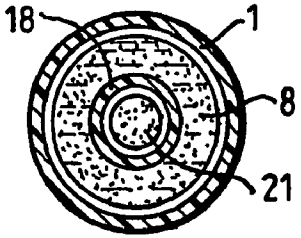
FIG. 13B is a section taken along line XIII-XIII of FIG. 13.
Figure 13A:
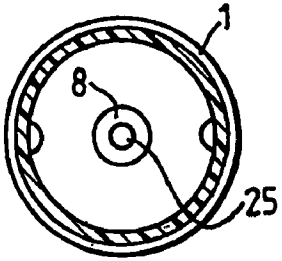
FIG. 13A is an end view of the marker pen shown in FIG. 13 in the direction of arrow A.

The marker pen illustrated in FIGS. 13, 13A and 13B is similar to those described previously except that the lengths of the wicks of the two nibs 14, 25 are substantially reduced. The inner nib 25 comprises an insertable cartridge 47 having a barrel 48 filled with a fibrous mass, a wick section 49 which protrudes into the fibrous mass present in the transorb 21 and a nib tip. As previously, fluid passes from the transorb 21 through the wick section 49 and the fibrous mass present in barrel 48 to the nib tip by capillary action. FIG. 13A shows the relative positions of the nibs 14, 25 in the end of the marker. The nibbed end of the marker pen is sealed by a releasable end cap 50. FIG. 13B shows the relative dimensions and locations of the transorbs 8, 21, the casing 1 and the housing 18.

Figure 14B:
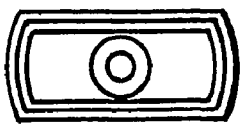
FIGS. 14A and 14B are sectional and end views of a further marker in accordance with the invention.
Figure 14A:
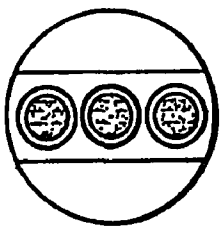
Figure 14:
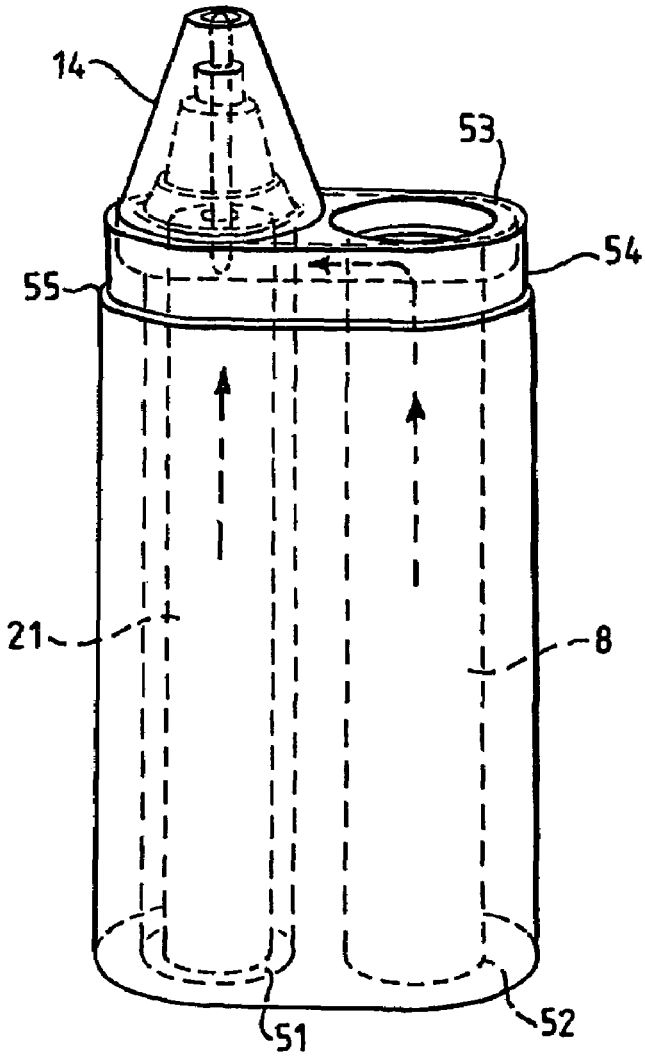
FIG. 14 illustrates partly in section a still further marker in accordance with the invention.

The marker pen shown in FIG. 14 differs from the previous embodiments in that the transorbs 8, 21 are positioned side-by-side, rather than coaxially or in-line. In the FIG. 14 embodiment, the casing 1 has two entirely separate compartments 51, 52 of circular cross-section. Other cross-sections could, of course, be employed. Each compartment receives a transorb as described previously. In this embodiment, however, each transorb comprises a fibrous mass in the form of a solid cylinder rather than an annulus. The outer nib 14 is generally of frustoconical shape and is hollowed to enable the inner nib 25 to protrude therethrough. The outer nib 14 includes a platform portion 53 which extends across the open end of the casing 1 and lies in contact with the upper open end of the transorb 8. Thus fluid retained within the fibrous mass of the transorb 8 can flow by capillary action via the platform 53 to the nib and thence to the nib tip. Typically the annular nib 8 and the platform are formed from a POREX material (a polymeric material). Forming is typically effected by moulding.

The end of the nib 25 remote from its tip protrudes into the fluid containing fibrous mass present in transorb 21. Thus, fluid can flow by capillary action from the fibrous mass to the nib and then to the tip. The exposed surfaces of the nibs and platform 53 are preferably covered by a removable end cap. The platform 53 and the frustoconical sides of the nib 8 are permanently or releasably covered by a cap 54. A lip 55 provided around the periphery of the casing 1 against which the cap rim abuts.

In an unillustrated embodiment similar to that shown in FIG. 14, the casing includes an additional chamber similar to chamber 52 positioned on the other side of chamber 51. Thus the casing comprises three side-by-side compartments, both outer compartments containing a transorb 8 each connected to a side of the platform 53. A section taken through such a casing is shown in FIG. 14A and an end view in FIG. 14B.

Figure 15:
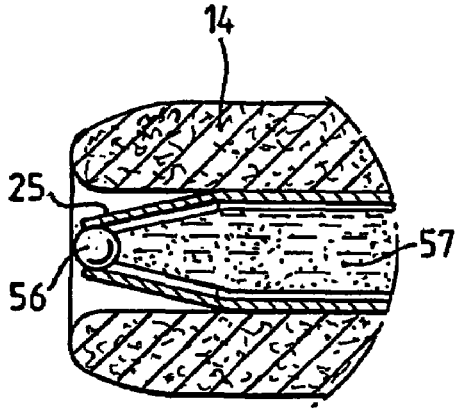
FIGS. 15 and 16 illustrate further markers in accordance with the invention.

In the embodiment illustrated in FIG. 15 the tip of the inner nib 25 comprises a ball bearing 56 which is retained in place by the tapered annular end wall of the nib 25. The unexposed surface of the ball bearing is in contact with the internal wick 57 of the nib to ensure that this surface is constantly replenished by fluid present in the wick. In the conventional way, as the nib is drawn over a surface, the ball bearing rotates to cause fluid to be transferred to a writing surface. The ball bearing may be produced from a metal, e.g. stainless steel, or comprise a ceramic material, a plastics material or a porous material such as POREX.

Figure 16:
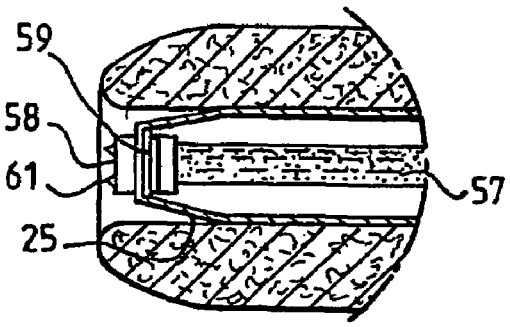

The tip of the nib of the marker pen illustrated in FIG. 16 comprises a roller 58 mounted for rotation between spindle retaining opposed recesses formed in the internal surface of the nib 25. The roller spindle is shown at 59. The unexposed surface of the roller is in contact with the internal wick 57 of the nib. The roller is provided with a pair of annular upstanding ribs 61 whereby two lines can be drawn at the same time by moving the roller over the surface of, say, a sheet of paper. One or more than two ribs may be provided.

As shown, the unexposed surfaces of the ribs 61 of the roller are in contact with the same wick. In an alternative arrangement, each rib may be in contact with a wick entirely separate from that contacted by the other rib. Thus, different fluids may be applied by the two ribs.

Figure 17:
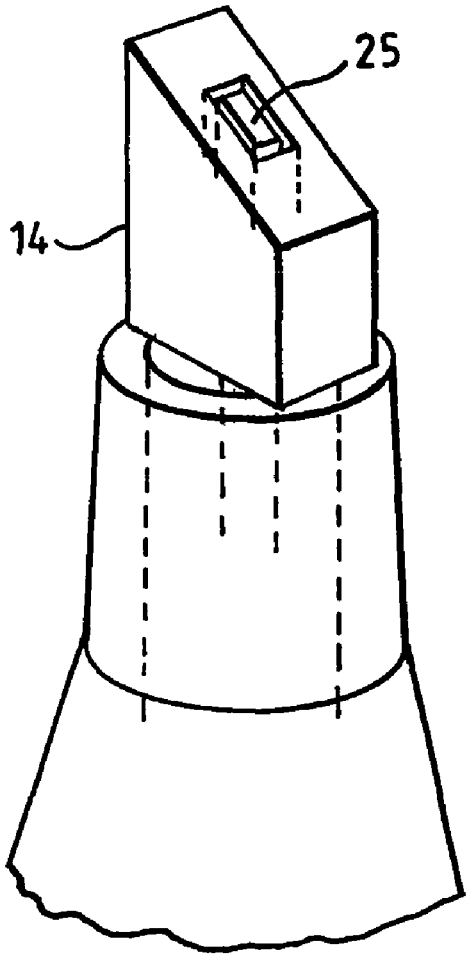
FIGS. 17 and 18 diagrammatically illustrated further embodiments of markers in accordance with the invention.
Figure 18:
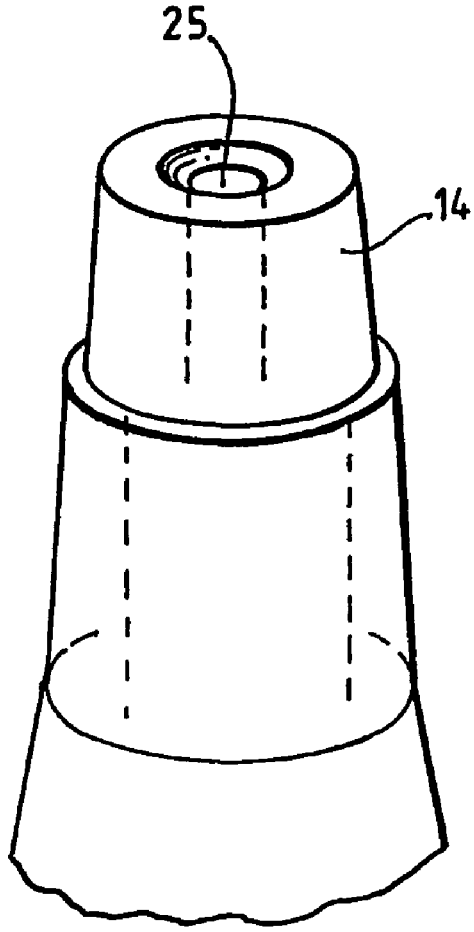

FIGS. 17 and 18 schematically illustrate two different nib profiles. In FIG. 15 both nibs are generally rectangular in section and in FIG. 16 both nibs are generally elliptical in section. One advantage of these nibs is an ability to vary the widths of the lines drawn simply by changing the orientation of the pen with respect to the paper.

As mentioned previously, the fluid present in transorb 8 may comprise an indicator such as a water-based ink containing a coloured dye, dispersed pigment or other colouring medium, or water. The fluid present in transorb 21 may comprise an indicator such as a water-based ink containing a dye of different colour to that present in the transorb 8, a dispersed pigment or other colouring medium, or a solution of an eradicating material which reacts chemically with a coloured dye or dispersed pigment in an ink or other colouring medium either to eradicate or cause a colour change in the colouring medium dispersed by the first nib.

Marker pens in accordance with the invention are used to produce a relatively wide stripe of one colour within the boundaries of which is a line or lines of another colour, or no colour. This effect is produced regardless of the direction of the pen over a writing surface such as a sheet of paper.

The stripe is produced by the annular or ring-shaped nib 14 and the inner line is produced by the nib 25. The roller of FIG. 16 can be used to produce two generally parallel lines. To produce a line of one colour bordered by the margins of a stripe of another colour, the transorb 8 from which fluid is transferred to the nib 14 is filled with an indicator ink containing a dye of a first colour and the transorb 21 from which fluid is transferred to the nib 25 is filled with a solution of an eradicating medium which reacts chemically with the dye of the indicator ink to change its pH and therefore the colour of the indicator ink dye. In use, movement of the nibbed end of the marker pen over a writing surface causes the eradicating solution dispersed by the nib 25 to react chemically with the coloured ink already dispensed by the annular nib 14 to produce a line of a colour different from that of the stripe. To produce a stripe with a central line of no colour, the eradicating solution is selected to change the wavelength value of the indicator ink to one which is outside the visible range.

This effect can also be produced by colour blending of two water-based inks of different colours. Thus, the transorb 8 is filled with a water-based ink of a first colour (e.g. yellow) and the transorb 21 is filled with a water-based ink of a second colour (e.g. blue). In use, movement of the nibbed end of the marker pen over a writing surface causes the coloured ink dispensed by the nib 25 to blend with the coloured ink dispensed by the nib 14 to produce, in the example given, a yellow stripe with a central green line.

To produce a water colour wash effect, one transorb may be filled with an indicator ink including a coloured dye and the other simply with water.

Because the fluids from the nibs 14, 25 are dispensed simultaneously blending at the edges of the line and stripe occurs to create a relatively soft edge which in turn creates an illusion of depth and contour. This effect can be described as a three-dimensional effect, that is it gives to the colour stripe a tubular appearance. Previously this has only been possible to achieve with great skill and artistic training. No marker pens are known which can produce this effect.

In an unillustrated embodiment the nibs 14, 25 may be supplied with fluids from external sources thereby removing the need for the transorbs 8, 21. Thus, fluid maybe transfered to the annular nib 14 by pads soaked with the required fluid and the nib 25 may be similary supplied or by a syringe or like device. Other means of externally replenishing the nibs may be employed. If fluid containing compartments are provided in the marker pen casing, these need not be directly linked by wicks to the respective pens. Alternatively, the source of fluid for the nibs may simply comprise seperate containers of the respective fluids. In this case, the fluids may conveniently be connected to the nibs through fluid absorbant wicks. Alternatively, the fluids may be conveyed by hand pressure applied to a flexible side wall of the pen casing, or by other means.

It will be appreciated that the foregoing is merely exemplary of marker pens in accordance with the invention and that modifacations can readily be made thereto without departing from the true scope of the invention.

The invention claimed is:

1. A marker pen which comprises a tubular housing, a first fluid retaining nib protruding from one end of the housing, and a second fluid retaining nib protruding from the same end of the housing wherein said nibs remain substantially stationary with respect to each other and means for separating the nib surfaces one from the other, the first nib being positioned and dimensioned to produce a stripe and the other nib being positioned and dimensioned to produce a line or lines between the boundaries of the stripe, the stripe and line or lines are produced in a single stroke of the pen.

2. A marker pen which comprises a tubular housing from one end of which protrudes a first fluid retaining nib replenished by fluid present in a first chamber positioned within the housing, and a second fluid retaining nib which also protrudes from the aforesaid end of the housing and is replenished by fluid present in a second chamber positioned within the housing wherein said nibs remain substantially stationary with respect to each other, the protruding nibs being spaced one from the other, wherein the first nib is positioned and dimensioned to produce a stripe and the other nib is positioned and dimensioned to produce a line or lines between the boundaries of the stripe, the stripe and line or lines being produced in a single stroke of the pen.

3. A pen as claimed in claim 1 wherein the first nib is produced from a porous material.

4. A pen as claimed in claim 1 wherein the second nib is produced from a porous material.

5. A pen as claimed in claim 4 wherein the second nib comprises a thin tube of an impermeable material formed with a capillary passageway or housing a porous fluid retaining material.

6. A pen as claimed in claim 5 wherein the fluid retaining material comprises a mass of fibrous material, a sponge, or a relatively solid porous material.

7. A pen as claimed in claim 1 wherein the first nib is formed with an opening through which the second nib can at least partially protrude.

8. A pen as claimed in claim 7 wherein the first nib is annular or ring-shaped in a plane normal to the longitudinal axis of the first nib.

9. A pen as claimed in claim 8 wherein the sides of the first nib lie generally parallel to its longitudinal axis.

10. A pen as claimed in claim 8 wherein the diameter of the first nib at its distal end is less than that at its housing encompassed end.

11. A pen as claimed in claim 10 wherein the first nib is generally frustoconical with a central bore passing from one end to the other.

12. A pen as claimed in claim 1 wherein the distal end of the first nib is generally flat.

13. A pen as claimed in claim 1 wherein, in cross-section, the outer contour of the first nib is oval, square, or rectangular.

14. A pen as claimed in claim 1 wherein the first nib comprises a generally annular array of a plurality of separate pieces of absorbent material, the second nib being able at least partially to protrude through the bore defined by the annular array.

15. A pen as claimed in claim 1 wherein the outer surface of the distal end of the first nib is relatively inflexible.

16. A pen as claimed in claim 15 wherein the first nib is formed at least partially from a polymeric material.

17. A pen as described in claim 15 wherein the first nib is formed at least partially from a felt or an expanded foam material.

18. A pen as claimed in claim 1 wherein the first nib is connected to receive fluid from a first chamber through a wick.

19. A pen as claimed in claim 18 wherein the first chamber comprises a transorb.

20. A pen as claimed in claim 18 wherein the fluid present in the first chamber comprises an indicator comprising a water-based ink containing a coloured dye, dispersed pigment or other colouring medium.

21. A pen as claimed in claim 18 wherein the fluid present in the first chamber comprises water.

22. A pen as claimed in claim 1 the distal end of the second nib is generally pointed.

23. A pen as claimed in claim 1 wherein the first or second nib in cross section is circular.

24. A pen as claimed in claim 1 wherein the second nib is connected to receive fluid from a second chamber through a wick.

25. A pen as claimed in claim 24 wherein the second chamber comprises a transorb.

26. A pen as claimed in claim 24 wherein the second chamber is tubular in cross-section with its outer wall lying adjacent to or in contact with the internal periphery of an annular first chamber.

27. A pen as claimed in claim 24 wherein the second chamber is positioned within the housing alongside the first chamber.

28. A pen as claimed in claim 24 the fluid present in the second chamber comprises an indicator comprising a water-based ink containing a coloured dye, dispersed pigment or other colouring medium, or a solution of an eradicating material which, in use, reacts chemically with a coloured dye or dispersed pigment in an ink or other colouring medium either to eradicate or cause a colour change in the colouring medium dispensed by the first nib.

* * * * *